US006890239B2

(12) United States Patent
Kopelle

(10) Patent No.: US 6,890,239 B2
(45) Date of Patent: May 10, 2005

(54) THERAPY BUDDY

(75) Inventor: Richard A. Kopelle, Rancho Mirage, CA (US)

(73) Assignee: My Therapy Buddy, Inc., Palm Springs, CA (US)

( * ) Notice: Subject to any disclaimer, the term of this patent is extended or adjusted under 35 U.S.C. 154(b) by 0 days.

(21) Appl. No.: 10/621,900

(22) Filed: Jul. 17, 2003

(65) Prior Publication Data

US 2004/0077280 A1 Apr. 22, 2004

Related U.S. Application Data

(60) Provisional application No. 60/397,323, filed on Jul. 19, 2002.

(51) Int. Cl.[7] ..... A63H 3/36; G09B 19/00

(52) U.S. Cl. ..... 446/320; 446/184; 446/297; 434/236; 434/237

(58) Field of Search ..... 446/26–28, 183–185, 446/297, 302, 327, 320, 369, 385, 397; 434/236–238, 393

(56) References Cited

U.S. PATENT DOCUMENTS

| | | | | | |
|---|---|---|---|---|---|
| 4,280,292 | A | * | 7/1981 | Hills | 40/538 |
| 4,710,145 | A | * | 12/1987 | Hall Vandis | 446/100 |
| 4,917,607 | A | * | 4/1990 | Van Hoose | 434/236 |
| 5,094,621 | A | * | 3/1992 | Friedel | 434/236 |
| 5,376,038 | A | * | 12/1994 | Arad et al. | 446/297 |
| 5,788,554 | A | * | 8/1998 | Goodwin et al. | 446/100 |

* cited by examiner

*Primary Examiner*—Bena Miller
(74) *Attorney, Agent, or Firm*—Ursula B. Day, Esq.

(57) ABSTRACT

A transitional object in the form of a plush creature having arms and legs with a soothing voice that provides comforting words can be activated by squeezing a sensor located in either foot and prompting soothing phrases including "everything is going to be all right" to reduce the level of stress and anxiety in a person.

8 Claims, 2 Drawing Sheets

THERAPY BUDDY

CROSS-REFERENCES TO RELATED APPLICATIONS

This application claims the benefit of prior filed provisional application, Appl. No. 60/397,323, filed Jul. 19, 2002, pursuant to 35 U.S.C. 119(e) and entitled "My Therapy Buddy—Plush Transitional Object With Voice", the subject matter of which is incorporated herein by reference.

BACKGROUND OF THE INVENTION

The present invention relates to a therapy buddy and in particular to a therapy buddy which is configured as a personal companion and which is also provided with a capacity to render words of comfort which are emotionally beneficial and which reduce anxiety.

Transitional objects are known in the prior art. For example, children are often provided with dolls or teddy bears so they can have a companion that is physically close and due to their tactile proximity, the child derives fun and comfort from the doll or teddy bear or also plush animal. Also typical as a transitional object is a baby blanket that is carried everywhere and that the child sleeps with for comfort. Toys can also bring comfort to a child as a playmate or even when the child is in distress. Even though a child may derive comfort from these toys, and oftentimes, the presence of a doll, teddy bear or plush animal will calm a child or can provide emotional well being to the child; they are mostly designed for entertainment and amusement.

The drawback of a doll or a teddy bear as a transitional object is mainly that dolls and teddy bears and plush animals are configured for children geared to the age group of children and thus, as toys are predominantly designed for entertainment and amusement although a toy may calm a child and for that reason they may have some aspects of comforting a child.

In the adult world however, there are many instances in which a person encounters either stress or where a person can benefit from a transitional object. Research has shown that adults can also benefit from the proximity of an object that offers tactile contact and that is soothing or that even can render soothing words. In clinical terms, a transitional object is the halfway point between receiving comfort and nurturing from a mother or other primary care giver and total reliance on the self which performs soothing functions and the development of enduring psychic structures in a person which eventually permit self-healing of the person.

A transitional object taps into the natural human self-preservation instinct. Studies in personality theory by Donald Woods Winnicott (1954, 1960) have shown that the concept of the seemingly universal need of a transitional object exists. When a person is at an emotional low point, where hopelessness and helplessness is felt, there is however always a reservoir of resilience available in that person. The transitional object can make someone aware of this self-healing ability and can guide a person back to a healthy balance of mind, body and spirit.

Winnicott possessed a profound appreciation for the developmental tasks of the early stages in life, in particular the concept of "the other". For Winnicott, the fundamental aspect of the human experience was the need for the other to become the one's self. In one of his papers published in 1958, he points out that that the capacity to be alone rests upon the capacity to be alone in the presence of the other. One cannot speak of "self" without at the same time talking of the "other". Winnicott's concept of the transitional object published in 1951 has been adopted within the framework of psychotherapy. The transitional object is the halfway point between total reliance on the actual presence of the self-object to perform soothing functions and the development of the enduring psychic structures within the self which permits self-soothing. The transitional object of a blanket, imaginary companion, or special toy in childhood allows the child to keep the mother/self object present in the child's consciousness, even in the absence of the mother. In the same vain, adults who have not been able to internalize the "good object" in childhood need a soothing self-object when experiencing anxiety and/or depression. Life transitions precipitate strains within the individual due to the stimulation of existing internal conflicts and heightened disequilibrium between the self and the environment.

A drawback of conventional talking articles is the intention of entertainment without any consideration to the continuous reassurance of emotional stability and mental health necessary when experiencing anxiety or depression. Combining the effects of the adjustable arms of the therapy buddy, a unique smile, and continuous reassuring spoken words, the therapy buddy provides the soothing and self-preserving function, which other figures having a talking function fail to simulate. The natural self-healing behavior of the transitional article is dependent on the configuration of the transitional article so that various types of users have the ability to gain the comfort of the transitional article.

It would therefore be desirable and advantageous to provide an improved transitional object to obviate prior art shortcomings and to provide a transitional object that can be used at any age and in any situation where a transitional object can have therapeutic input.

SUMMARY OF THE INVENTION

According to one aspect of the present invention, a transitional article is provided, in particular, an article which is configured to provide reassurance and permit self-healing to a user experiencing trauma, anxiety, depression, or psychic pain, so that after repeated use, the effect becomes a permanent soothing component in the user's healing process.

In accordance with another aspect of the present invention, the transitional article is a transitional companion which reduces strain and allows for regaining equilibrium, thus helping an individual to cope with past and present trauma, anxiety, depression and psychic pain. The therapy buddy according to the present invention acts as a vehicle for the "internalization" of various maternal-like functions, which are considered the building blocks of psychic structure and an "optimal" fit for the environment. (The Facilitating Environment, Clinical Application of Donald W. Winnicott's Theory, Editors: M. Gerard Fromm, PhD. Bruce Lazar Smith, PhD., 1989).

In accordance with a further aspect of the present invention, the transitional companion in the form of a talking therapy buddy for providing reassurance to a person and for self-healing, the therapy buddy includes a body assembly with an outer covering of soft material and an interior body cavity; a head portion having a face with calm and tranquil features; two elongated flexible arm portions, two leg portions; an electronic circuit including a sound module housed in the body cavity and a power source; and a plurality of switching means covered by said outer covering, and associated with the leg portions of the assembly and connected to the electronic circuit so as to provide a switch signal response to a person's touching of the respective leg portion switch; and wherein the sound means includes a voice synthesizing means for electronic synthesizing a plurality of soothing, reassuring, comforting, and universal words in response to a switch signal provided; the voice synthesizing means including speaker means for audibilizing said electronically synthesized words, and sequencing means coupled between said plurality of switch means and said voice synthesizing means, said sequencing means for providing a sequence of control signals to said synthesizing means responsive to said switch means to cause said synthesizing means to synthesize a sequence of words responsive to said switch means providing a switch signal.

The present invention resolves prior art problems by providing a A transitional article which responds to the touching of sensors located in the figure's left and right foot. The sensor in one foot activates the speaker to say, "Everything is going to be all right." The sensor in the other foot activates the speaker to say, "Feel the words. Everything is going to be all right." And activating the sensor a third time the voice says, "Believe it. Everything is going to be all right." All aspects of the article, the shape, fabric, stuffing, facial expression, and most especially the words, were designed to create an article that would ensure to the user a balance of mind, body, and spirit. The optimal result is a reduction in the level of stress and anxiety.

It is a feature of the present invention that the soft huggable therapeutic buddy can be accessed any time it is needed in the privacy of the home or elsewhere in a comfortable location, The user being held by the therapeutic buddy can activate the comforting messages by applying a slight pressure to either the right or the left foot. Since the shape of the therapeutic buddy as well as the material from which it is composed and the messages it renders present universal signals the brain of a person, access thereof by anyone in distress can be had anytime any place. Since our fears are most often created by our minds, the specific words provided by the therapeutic buddy have a positive and calming effect on someone in a time of urgent need. After prolonged repeated use, the effect becomes a permanent soothing component in that person's healing process.

Even though the therapeutic buddy is not intended to replace professional counseling, it is meant to be there between therapy sessions and other ongoing therapeutic counseling. There is a universal need in humans for nurturing words that can ease the mind, especially from an always available "buddy".

In accordance with another feature of the present invention, the therapeutic buddy is useful in situations including the following:

For adolescents: when parental pressure is overwhelming, when school responsibilities cause anxiety, when learning difficulties hamper the ability to concentrate, when peer pressure is too much and causes stress, when self-esteem problems arise, when a feeling that one does not fit in arise, in connection with weight or eating issues, when not being understood, when experiencing physical and sexual abuse.

For adult situations: when family obligations are overwhelming; when work causes anxiety; when depression sets in for no apparent reason; when panic attacks strike; when feeling helpless and hopeless; when sleep disorders happen; when money issues cause stress; when everyday matters overwhelm, when experiencing psychic pain in divorce and break up of a marriage.

For seniors: When coping with health problems is difficult; when feeling unneeded and unwanted; when financial matters cause anxiety; when the world seem to move too fast; when loss of loved ones cause overwhelming sadness; when the sense of belonging is lost, when anxiety about burdening others arise; when fear or panic attacks strike; when loneliness causes sorrow.

In accordance with the present invention, the therapy buddy is a plush creature with a voice that soothes and comforts. The therapy buddy is a unique shaped creature that talks words to soothe users of all ages.

BRIEF DESCRIPTION OF THE DRAWINGS

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
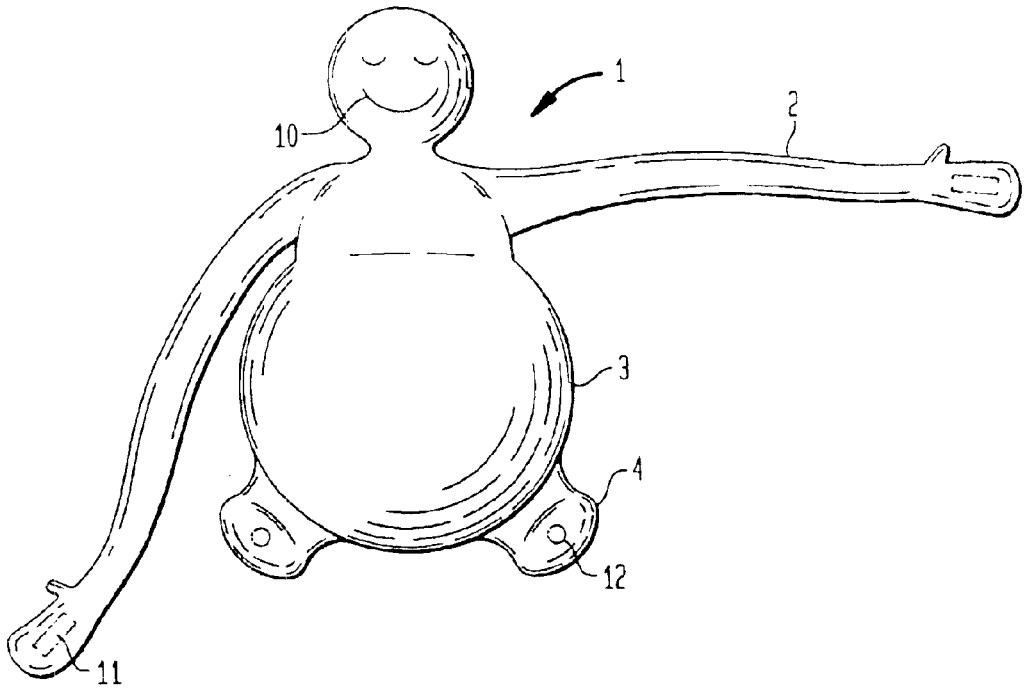
FIG. 1 is a front view of one embodiment of the therapy buddy according to the present invention.

Throughout all the Figures, same or corresponding elements are generally indicated by same reference numerals.

Turning now to the drawing, and in particular to FIG. 1, there is shown a front view of a transitional article, the therapy buddy 1 with arms 2 a body 3 and a face 10 which includes a smiling mouth and eye lids. The mouth and lids in the face can have a variety of expressions but are always configured with a calm and friendly demeanor. The buddy 1 is generally configured with an outer cover of a soft material. Shown here is an embodiment of a therapy buddy 1 made from plush material. Any other soft material can also be used. Arms 2 are made also from soft and pliable material. Body 3 has a generally three dimensional appearance and is seen here as having a rounded dimension. Arms 2 are attached on each side and are dimensioned for over-length relative to the size of the body 3, so that the arms can be slung around the user. Palms 11 are provided with a hook and loop type closure such as Velcro®. In that manner, the arms 2 can be manipulated around the user into an embrace by the arms 2. Leg portions 4 can be configured in variety of ways. In the embodiment as shown, the leg portions are somewhat short and stubby. The leg portions are provided with activation pads 12.

Figure 2:
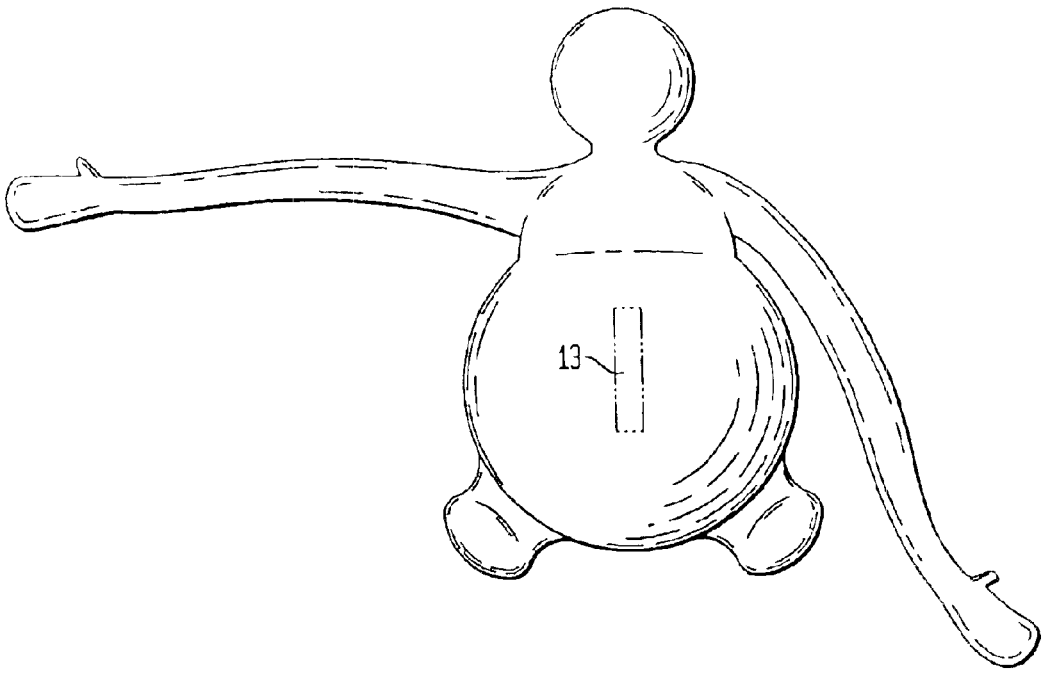
FIG. 2 is a back view of the therapy buddy of FIG. 1.

FIG. 2 shows a back view of the therapy buddy with an opening pocket 13 in the body for insertion of speaker and battery. The pocket can be accessed by a flap that can be opened and closed by means of a hook and loop type closure such as Velcro®.

Figure 3:
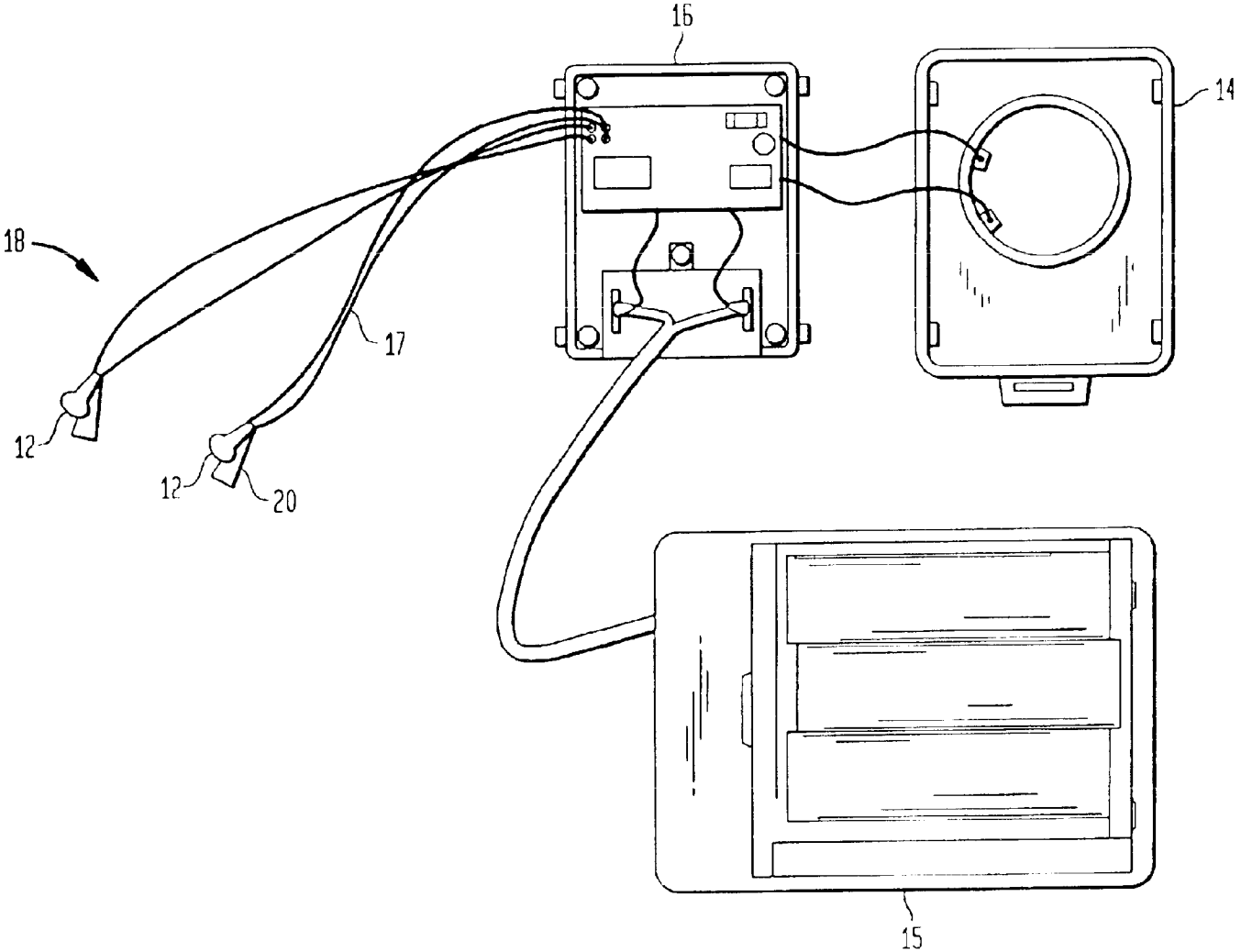
FIG. 3 shows the voice activation system of the therapy buddy.

FIG. 3 shows the sound module 16 and a speaker 14 for placing inside the therapy buddy. From the sound module 16 wires 17 extend for transmission of a signal from respectively right and left sensors 18 which terminate in the leg portions 4, and which are each connected to the sound module 16. The right and left sensors 18 are each activated by rubber keys 20. The rubber keys 20 are connected to activation pads 12 which are part of the leg portions 4 of the therapy buddy 1. As shown in FIG. 1, the voice activation pads 12 are shown here at legs 4. However, the activation pads can be anywhere on the buddy.

The sound module 16 is provided with an electronic chip and has a voice synthesizer and means to deliver phrases in sequence. A battery bay 15 is connected to the sound module 16. It is also possible to activate the synthesized voice by wireless connection not shown here. The phrases that are programmed on the chip can include anything that is considered soothing to a user and can be in any language.

In operation, the arms 2 of the therapeutic buddy 1 are placed around a users' neck or shoulders and attached to the user's clothing by the Velcro pads 11. Alternatively, the Velcro® pads 11 of the buddy's arms 2 can also be attached to each other to thereby provide an "embrace" by the arms 2. Depending upon demand, one of the activation pads 12 in the leg portions 4 is activated to initiate the voice activation to say "Everything is going to be all right". When activating the other leg pad 12, the sensor 18 in the other activation 4 is activated to render the words "Hear my voice. Everything is going to be all right" Activating the sensor 18 a second time, he voice says "Feel the words. Everything is going to be all right". When activating a third time, the voice says: "Believe it. Everything is going to be all right" to thereby reduce stress and anxiety.

Optionally, a traveling bag can be provided for the therapy buddy.

While the invention has been illustrated and described as embodied in a therapy buddy, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A transitional companion in the form of a talking buddy for providing reassurance to a person and for self-healing, the companion comprising:

a body assembly, with a corpulent torso and an outer covering of soft material and an interior body cavity;

a head portion having a face with closed eyes two elongated flexible arms of a length to fit around the torso of a person and configured to be attachable to a substrate, two truncated leg portions provided with activation pads;

an electronic circuit including a sound module housed in the body cavity and connected to a power source; and a plurality of switching means covered by said outer covering, and associated with the leg portions of the assembly and connected to the electronic circuit so as to provide a switch signal response to a user's touching of the respective leg portion activation pads; and wherein the sound module includes a voice synthesizing means for electrical synthesizing a plurality of soothing, reassuring, comforting, and universal words in response to the switch signal provided; the voice synthesizing means including speaker means for audibilizing said electronically synthesized words.

2. The transitional companion of claim 1, further comprising sequencing means coupled between said plurality of switch means and said voice synthesizing means, said sequencing means for providing a sequence of control signals to said synthesizing means responsive to said switching means to cause said synthesizing means to synthesize a sequence of words responsive to said switching means providing the switch signal.

3. The transitional companion of claim 1, wherein the outer cover is made from plush material.

4. The transitional companion of claim 1, wherein the head portion has facial features wherein the facial features include closed eyelids and a smiling mouth.

5. The transitional companion of claim 1, wherein the body assembly includes a torso having a rotund shape.

6. The transitional companion of claim 1, wherein the chip in a sound module is programmed to render the phrases: "Everything is going to be all right", "Hear my voice, everything is going to be all right", "Feel the words, everything is going to be all right", "Believe it, Everything is going to be all right" sequentially upon activating the pads.

7. A method of reducing stress in a person by means of a therapy buddy according to claim 1 comprising the steps of:

providing the therapy buddy to the person in stress;

folding the arms of the therapy body around the person;

activating the switching means switches by the activation pads at the legs of the therapy buddy to thereby trigger a mechanism to render its recorded soothing phrases; and listening to the soothing phrases until the stress in the person is reduced.

8. The transitional companion of claim 1, wherein the chip in a sound module is programmed to render a sequence of suitable stress reducing phrases upon activation of the switching means.

* * * * *